US005544024A

United States Patent [19]

Wittern, Jr. et al.

[11] Patent Number: 5,544,024

[45] Date of Patent: Aug. 6, 1996

[54] MEANS AND METHOD FOR ILLUMINATING PARTS OF A VENDING MACHINE

[75] Inventors: Francis A. Wittern, Jr., Des Moines; Paul L. Hawkins, Guthrie Center, both of Iowa

[73] Assignee: Fawn Engineering Corporation, Des Moines, Iowa

[21] Appl. No.: 538,397

[22] Filed: Oct. 3, 1995

[51] Int. Cl.[6] ..... F21V 33/00

[52] U.S. Cl. ..... 362/89; 362/234; 362/253; 362/260

[58] Field of Search ..... 362/28, 29, 30, 362/85, 89, 234, 253, 125, 260, 223, 224, 812, 329

[56] References Cited

U.S. PATENT DOCUMENTS 5,197,793 3/1993 Stone ..... 362/260 X

*Primary Examiner*—Stephen F. Husak

*Attorney, Agent, or Firm*—Zarley, McKee, Thomte, Voorhees & Sease

[57] ABSTRACT

An apparatus and method for illuminating portions of a vending machine includes an internal light source that is used to generate light inside a housing defining the vending machine. A user interface including such things as a money or token receiver, selection buttons, and coin return, has an external surface that can be operated by a customer or a vendee. Light from the light source is transmitted from inside the housing to outside the housing and unto selected portions of the user interface. This can be accomplished by using windows or other light conduits to provide illumination of the external face of the user interface to assist in user operation at night and especially in places that do not include a lot external lighting.

19 Claims, 1 Drawing Sheet

MEANS AND METHOD FOR ILLUMINATING PARTS OF A VENDING MACHINE

BACKGROUND OF THE INVENTION

A. Field of the Invention

This invention relates to vending machines, and in particular, to illuminating various parts of a vending machine.

B. Problems in the Art

Vending machines have become pervasive in modern society. A primary advantage of a vending machine, both from the standpoint: of the vendor and the vendee, it is that there is no requirement of human supervision or involvement in the transaction other than the vendee. While many vending machines all are placed inside buildings or accessible only during business hours. Vending machines can be placed in remote isolated areas and in places that do not have a significant amount of lighting.

In the situation where vending machines will be utilized at night or in conditions where there is low ambient light, there is a need to assist a vendee in operating the vending machine by providing sufficient sight of the control elements related to receiving money or tokens, selecting a desired vendible item, and receiving any change, and the like.

Many types of vending machines utilize interior lighting to illuminate selections for view by the vendee. Some vending machines, which do not provide a view of the items that can be selected, illuminate a display which advertises the content of the vending machine. For example, many canned soft drink vending machines have a translucent front panel that is backlit by interior lighting inside the vending machine and which displays the trademark or trademarks of the product inside the machine.

The control elements such as selection buttons are also many times backlit from a light source or sources inside the machine. If not backlit or otherwise illuminated, the control elements (also for purposes of this description will be referred to as the user interface) may be difficult to use, even if the front display panel is backlit or the products inside the machine are visible and lit from light sources inside the machine., Therefore, a need has been identified to provide or increase the illumination of user interfaces of vending machines. There is also room for improvement regarding the cost and complexity of current systems for providing illumination for the display or vendible items and illumination for user interface.

It is therefore a primary object of the present invention to provide an illumination system for vending machines which improves over the state of the art.

Another object of the present invention is to provide a means and method for illuminating vending machine which provides adequate illumination of a user interface components of a vending machine, even at night and in locations where there is not a significant amount of external lighting.

Another object of the present invention is to provide a means and method as above described which can provide the dual function of illuminating at least portions of a user interface and provide back lighting front panel display or lighting vendible items for other uses.

Another object of the present invention is to provide a means and method as above described which is economical, durable, and efficient.

Another object of the present invention is to provide a means and method as above described which can reduce or eliminate structure or components that otherwise might be needed for illumination of user interface.

These and other objects, features, and advantages of the present invention will become more apparent with reference to the accompanying specification and claims.

SUMMARY OF THE INVENTION

The present invention relates to an apparatus and method for illuminating portions of a vending machine. The method includes providing a light source in the interior of the enclosure defining the housing of the vending machine, and illuminating a portion of the vending machine from that position inside the housing. Light from that light source is concurrently transmitted outside the housing but onto selected parts of the user interface. The method therefore uses one light source for two functions. It also provides illumination onto the exterior of the user interface, rather than trying to rely on back lighting or no lighting which makes it difficult for a vendee to effectively use the vending machine at night, especially where there is not much, if any, external lighting.

The apparatus includes the light source inside the housing, a light conduit which allows transmission of light from the light source externally of the housing onto at least a portion of the external side of the user interface.

DETAILED DESCRIPTION OF THE PREFERRED EMBODIMENT

Figure 1:
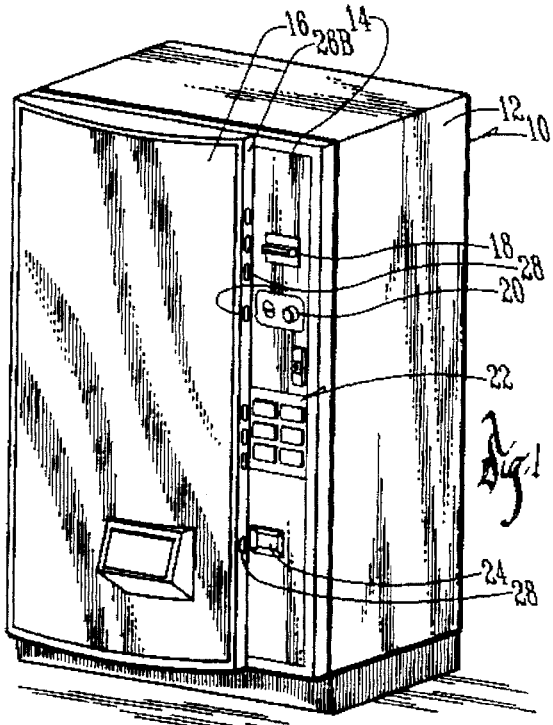
FIG. 1 is a perspective view of one type of vending machine.

To assist in an understanding of the invention, a detailed description of one embodiment according to the invention will now be set forth. The drawings accompanying this description will be frequently referenced. Reference numerals and/or letters will be used to point out certain parts and locations in the drawings. The same reference numerals and/or letters will be used to indicate the same parts and locations throughout the drawings unless otherwise indicated.

FIG. 1 illustrates a vending machine 10 having a housing 12 which basically defines an enclosure. Housing 12 prevents access to either money or vendible products by an unauthorized person. The front side 14 of housing 12 includes a display panel 16 and what will be called collectively the user interface. Specifically the user interface in this example consists of a bill changer 18, a coin or token receiver 20, a selection panel 22, and a coin return 24. As can be seen, each of the elements of the user interface are spaced apart along the right margin of front side 14.

As is well known in the art, display panel 16 can be a plastic or similar material which is translucent and which bears some sort of indicia, usually advertising. In this embodiment, display panel 16 is raised from the plane of front side 14, which generally contains all the components of the user interface. Therefore, as further shown in FIGS. 2 and 3, transition pieces 26A and 26B extend perpendicularly outward from the plane of front side 14 along the right side of raised display panel 16. In this embodiment, transition pieces 26A and 26B are two metal support pieces which grip and frame a side of display panel 16, and are held together by fasteners such as screws 17. As will be described in more detail later, in this embodiment a plurality of small windows 28 are positioned along the length of transition piece 26B. A corresponding plurality of small windows 27 are positioned along the length of transition piece 26A and basically line up with windows 28. Windows 27 and 28 allow light generated inside of housing 12 to pass outside of housing 12 and illuminate selected portions of the user interface.

Figure 2:
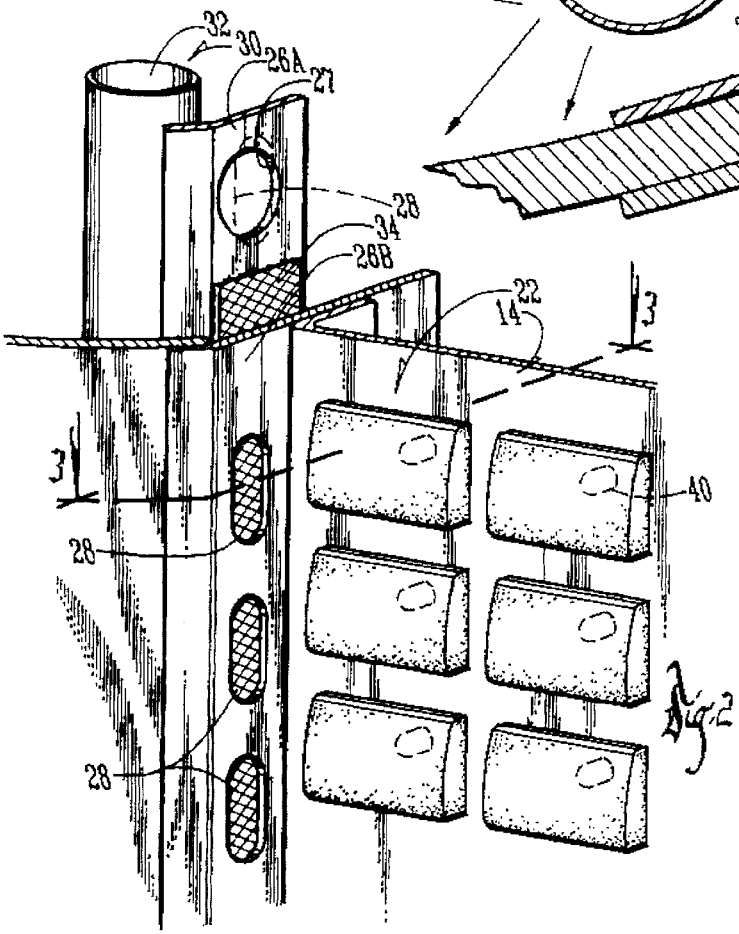
FIG. 2 is an enlarged partial perspective view of a part of a user interface for the vending machine of FIG. 1 and a part of a light source internal to the vending machine which is normally used for back lighting a front panel display of the vending machine, along with windows in the housing to allow light from the light source to pass to the user interface.

FIG. 2 illustrates in larger detail the relationship of windows 27 and 28 to the light source 30 and the user interface components. In this embodiment, one or more fluorescent lights 32 are positioned vertically and spaced apart behind display panel 16 to back light it. As shown in FIG. 2, one of lights 32 is positioned generally adjacent to transition pieces 26A and 26B, which are directly adjacent to user interface for machine 10. As can be seen in FIG. 2, windows 27 and 28 can consist of circular and elongated openings in transition pieces 26A and 26B respectively, the openings specifically positioned to generally correspond with a particular component of the user interface. In FIG. 2 three sets of windows 27 and 28 are positioned to basically cover the length of selection panel 22. FIG. 1 shows one set of windows 27 and 28 is positioned to cover the vertical length of coin return 24, while no windows 27 or 28 are positioned along the vertical space between coin return 24 and selection panel 22.

As shown in FIG. 2, the light adjacent to transition pieces 26A and 26B in particular will thereby function to back light at least the right side of display panel 16 while at the same time send light through windows 27 and 28 to illuminate the exterior surface of selection panel 22. The light from light 32 of interior light source 30 for machine 10 would therefore accomplish the dual function of back lighting display panel 16 and front lighting or illuminating selection panel 22.

Figure 3:
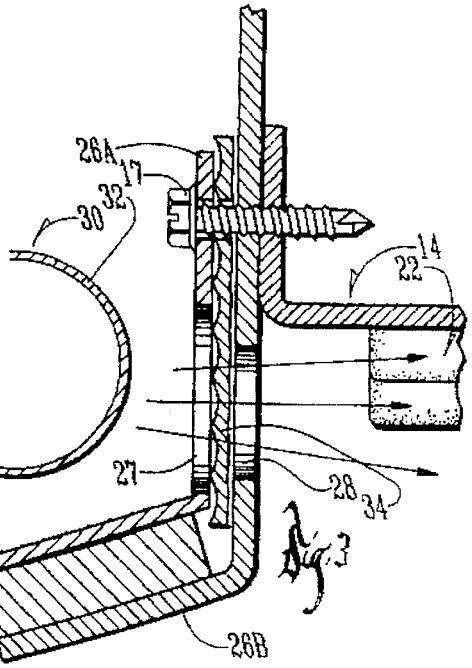
FIG. 3 is a sectional view taken along line 3—3 of FIG. 2.

FIG. 3 illustrates how light would be directed in such a manner for this dual function. In the preferred embodiment a light transmissive piece 34 such as clear plastic is sandwiched in a covering and sealing fashion between to windows 27 and 28. Light transmissive piece or pieces 34 would therefore serve to prevent the elements or debris from entering housing 12, yet allow light to pass to illuminate the user interface.

FIG. 3 illustrates that in this embodiment, even thought light 32 is positioned somewhat in or even back of the plane in which the user interface exists, window 27 and 28, by utilizing light transmissive pieces 34, refracts light in a manner that assists in illumination of user interface elements.

It is to be understood of course that any or all of the user interface elements 18, 20, 22, and 24 can be illuminated using windows 27 and 28.

The method according to the preferred embodiment utilizes an internal light source to illuminate an external surface of the housing by transmitting light from inside the housing to a portion of the exterior of the housing. It is to be understood that the apparatus and method according to the invention can be adopted for a variety of situations and configurations.

It will be appreciated that the present invention can take many forms and embodiments. The true essence and spirit of this invention are defined in the appended claims, and it is not intended that the embodiment of the invention presented herein should limit the scope thereof.

For example, light transmissive pieces 34 are not necessarily needed. It is preferred, however, to cover and seal any openings to the interior of machine 10. Light transmissive pieces 34 can be made out of a number of different types of materials including glass, plastics, and other light transmissive materials and do not have to be clear but could be somewhat translucent. In the preferred embodiment piece 34 has a scalloped interior surface to assist in spreading light. Other shapes are possible.

The shape and size of windows 27 and 28 can vary according to need. Their position relative to user interface components can also vary. Not all of the user interface components are required to be illuminated.

Additionally, it is not required that the light source be used to back light a display panel. Any light source that is interior to the housing could utilize components to transmit light to an exterior surface to be illuminated.

Finally, FIG. 3 shows in ghost lines lights 40 to illustrate that the present invention could eliminate lights 40, which would generally otherwise have to be used to back light such things as the selection panel 22. Eliminating lights 40 would eliminate the attendant mounting structure, wiring, and other components which would add to the cost and complexity of machine 10. It is to be understood that it may not be feasible to back light coin receiver 20 or coin or token receiver 20. Therefore the invention assists the vendee in this way also.

One specific example of the advantage of the present invention would be with vending machines that are placed in locations that do not have significant amount of external lighting if any. Examples would be vending machines for vending bait or other vendible items for fisherman that fish at night. The vending machine may be in a location that does not have a lot of external light and therefore it would be significant to illuminate as many portions of the user interface as possible.

We claim:

1. An illumination apparatus for a vending machine comprising:

an enclosed housing having an interior and an exterior;

a light source in the interior of the housing;

a portion of the housing comprising a display utilizing the light source to backlight the display;

a window in the housing positioned to allow light from the light source to pass from the interior of the housing and illuminate a portion of the exterior of the housing.

2. The apparatus of claim 1 wherein said portion of the exterior of housing includes at least some of a user interface for the vending machine.

3. The apparatus of claim 1 wherein the user interface includes a selection control for selecting a desired vendible item.

4. The apparatus of claim 1 wherein the user interface includes a device to receive credit to enable selection of a vendible item.

5. The apparatus of claim 1 wherein the user interface includes a bill changer.

6. The apparatus of claim 1 wherein the light source is positioned adjacent a portion of the display which is adjacent the portion of the exterior of the housing.

7. The apparatus of claim 1 wherein the window comprises an opening in the housing covered by a light transmissive member.

8. The apparatus of claim 1 further comprising a plurality of windows.

9. The apparatus of claim 1 wherein the window refracts light from the light source towards the portion of the exterior of the housing.

10. The apparatus of claim 1 wherein the light source is fluorescent.

11. The apparatus of claim 1 wherein the light source comprises several lights spaced apart behind the display.

12. A method of lighting a control panel of a vending machine to assist in operation of the machine at night, where the machine comprising a housing enclosing vendible items and dispensing apparatus, the housing having a front that includes the control panel and display adjacent the control panel, comprising:

back lighting the display with a light source inside the housing;

illuminating the outer surface of at least a portion of the control panel with light from the light source.

13. The method of claim 12 wherein the step of illuminating is accomplished by placing an opening in the housing between the light source.

14. The method of claim 13 further comprising placing a light transmissive piece in the opening.

15. The method of claim 12 wherein the portion of the control panel includes a user interface comprising one or more of a bill changer, a token receiver, a selection button or buttons, and a coin return, and the illumination is directed primarily at a part of the user interface.

16. The method of claim 12 wherein the portion of the control panel is illuminated to a level that reduces or eliminates the need for back lighting of the portion of the control panel.

17. A dual purpose lighting system for vending machines comprising:

an enclosed vending machine body having a front side;

the front side comprising a backlit display portion and a control portion including selection buttons, money or token validator, and coin return; the display portion and the control portion having front and back surfaces and having edges positioned generally adjacent to one another along a boundary;

a light source positioned behind the back surface of the display portion inside the body; one or more light conduits positioned generally along the boundary, the light conduits providing a path for light from the light source to pass from inside the body and illuminate at least parts of the front surface of the control portion.

18. A device for concurrently, with an interior light source, back lighting a display portion of a vending machine and illuminating an exterior portion of a vending machine, to eliminate separate light sources to back light the exterior portion, and provide illumination of the exterior portion to assist in use of the vending machine at night in locations without significant external light, comprising:

a window in the housing positioned to allow light from the light source to pass from the interior of the housing and illuminate a portion of the exterior of the housing.

19. A vending machine including an enclosed housing containing vendible products and a front side, the front side including a control panel and adjacent to the control panel a display panel, the display panel being backlit by a light source positioned inside the housing and adjacent to the front side, the improvement comprising:

a light conduit positioned between the light source and the control panel, the light conduit conducting a portion of light generated by the light source from inside the enclosed housing to outside the enclosed housing and illuminating at least a portion of the control panel.

* * * * *